United States Patent [19]

Hirono

[11] Patent Number: 4,698,735

[45] Date of Patent: Oct. 6, 1987

[54] DECORATOR LAMP

[75] Inventor: Akira Hirono, Kyoto, Japan
Hirono, Kyoto, both of Japan

[73] Assignee: Kuroi Glass Industry Co., Ltd., Kyoto, Japan

[21] Appl. No.: 833,140

[22] Filed: Feb. 26, 1986

Related U.S. Application Data

[62] Division of Ser. No. 679,059, Dec. 6, 1984, abandoned.

[30] Foreign Application Priority Data

Apr. 12, 1984 [JP] Japan ..... 59-52710
Jun. 25, 1984 [JP] Japan ..... 59-93772

[51] Int. Cl.[4] ..... F21V 5/00

[52] U.S. Cl. ..... 362/230; 362/235; 362/293; 362/311; 362/806

[58] Field of Search ..... 362/311, 293, 333, 334, 362/335, 338, 32, 806, 230, 235, 252

[56] References Cited

U.S. PATENT DOCUMENTS

| | | | |
|---|---|---|---|
| 1,022,928 | 4/1912 | Bradshaw | 362/338 |
| 1,636,141 | 7/1927 | Mammen | 362/252 |
| 1,654,150 | 12/1927 | Thompson | 362/235 |
| 2,015,235 | 9/1935 | Rolph | 240/103 |
| 2,197,040 | 4/1940 | Graf | 362/32 |
| 2,265,670 | 12/1941 | Platt | 362/338 |
| 4,141,058 | 2/1979 | Mizohata et al. | 362/32 |
| 4,222,091 | 9/1980 | Bartenbach | 362/32 |

FOREIGN PATENT DOCUMENTS

| | | |
|---|---|---|
| 2717773 | 10/1978 | Fed. Rep. of Germany . |
| 812394 | 4/1959 | United Kingdom . |
| 1111568 | 5/1968 | United Kingdom . |

*Primary Examiner*—Andrew M. Dolinar
*Attorney, Agent, or Firm*—Wegner & Bretschneider

[57] ABSTRACT

A decorator lamp is composed of a glass body having a surface concave toward the center of the surface and defining a through-hole formed at a desired position of the glass body in such a manner that the outer dense layer of the glass body is removed at the desired position, and a light source placed within the bore. The light source may be formed of a central bulb and a plurality of miniature bulbs arranged underneath the central bulb in such a way that the miniature bulbs are located within the through-hole and when seen in a plan view of the decorator lamp, the miniature bulbs surround the central bulb. The light from the light source is thus reflected back inwardly by the outer dense layer of the glass-made main body. It is also reflected by the walls of lands and recesses formed in the circumference of the glass-made main body. A variety of colors are thus produced at such dense layer, lands and recesses, depending on the angles of reflected light beams, thereby making the decorator lamp useful.

9 Claims, 8 Drawing Figures

DECORATOR LAMP

This application is a divisional of Ser. No. 679,059, filed Dec. 6, 1984, now abandoned.

This invention relates to a decorator lamp, and more particularly to a decorator lamp in which light from a light source is guided to one or more desired specific portions of the lamp so as to render the desired specific portions selectively luminous.

In conventional decorator lamps of the above sort, light sources were arranged outside their main bodies made of glass or the like and light beams emitted from the light sources were reflected by the surfaces of their respective main bodies so as to bring about certain decorative or artistic effects. They were however unable to develop diverse color variations or to render the main bodies at certain selected portions thereof unless some specific directivity was imparted to the colors of the main bodies or light sources or certain colored light beams were given off. Such conventional decorator lamps were thus accompanied by such drawbacks that they required complex devices and their prices were hence high.

An object of this invention is to solve the above-mentioned drawbacks of conventional decorator lamps. It has now been found that the object can be attained by providing a light source, preferably centrally, within the main body of a decorator lamp and making the main body internally luminous to achieve beautiful illumination owing to light beams passing through the main body. It has also been found that use of a separate light source permits production of varied illumination.

In one aspect of this invention, there is thus provided a decorator lamp which comprises a glass body having a surface concave toward the center of the surface and defining a through-hole formed at a desired position of the glass body in such a manner that the outer dense layer of the glass body is removed at the desired position, and a light source placed within the bore.

In another aspect of this invention, there is also provided a decorator lamp which comprises a glass body having a surface concave toward the center of the surface and defining a through-hole formed at a desired position of the glass body in such a manner that the outer dense layer is removed at the desired position, a light source provided in the through-hole and composed of a central bulb and a plurality of miniature bulbs arranged underneath the central bulb in such a way that the miniature bulbs are located within the through-hole and when seen in a plan view of the decorator lamp, the miniature bulbs surround the central bulb.

In each of the above aspects of this invention, light emitted from the light source is allowed to pass through the glass body while being reflected back inwardly by the outer dense layer. Therefore, the light is radially and outwardly guided and is then reflected by reflecting facets, which have been formed by cutting the glass body, and/or emerge through radial tip portions of the outer dense layer, thereby rendering the facets and/or radial tip portions luminous. Accordingly, the decorator lamp can produce a variety of colors and can also give off light at certain specific positions, without need for any complex structure or devices. Especially, the decorator lamp according to the second aspect of this invention can produce varied illumination owing to its incorporation of the plurality of miniature bulbs in combination with the central bulb. The central bulb and miniature bulbs may be turned on either simultaneously or separately or even alternately.

The above and other objects, features and advantages of the present invention will become apparent from the following description and the appended claims, taken in conjunction with the accompany drawings, in which:

Figure 1:
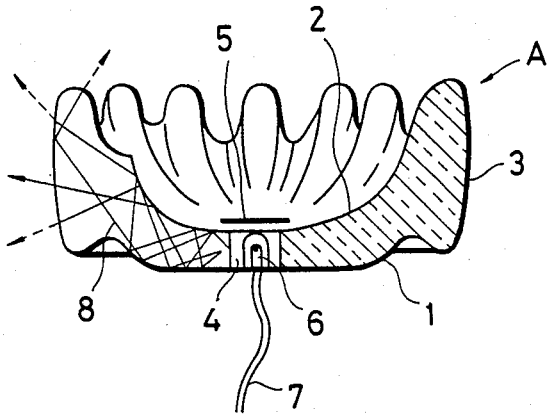
FIG. 1 is a vertical cross-sectional view of a decorator lamp according to the first embodiment of this invention.
Figure 2:
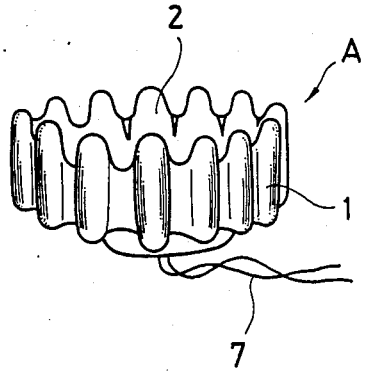
FIG. 2 is a perspective view of the decorator lamp.

Referring first to FIG. 1 and FIG. 2, the principle of this invention will be described. The main body of the decorator lamp is designated at letter A, which is a glass body formed by the usual molding technique. Numeral 1 indicates the lower surface of the decorator lamp while numeral 2 designates its upper surface. It should however be bone in mind that the decorator lamp will be rendered upside down when installed on a ceiling. Designated at numeral 3 is an outer dense layer formed in the outer surface of the glass body A. This outer dense layer 3 is naturally formed when a molten glass is shaped in a usual manner. Namely, the molten glass may be shaped for example by pouring it in a mold. The glass surface is cooled faster than the interior glass by the surrounding air or by the inner surface of the mold. Thus, a thin layer which is denser than the internal glass is formed in the outer surface of the thus-shaped glass body. Accordingly, light beams 8 which have entered the glass body are inwardly reflected back by the layer 3 and are hence guided radially and outwardly to tip portions of the glass body. At the tip portions, the light beams become incident light beams having angles greater than the critical reflection angle (about 40 degree for glass) and are thus allowed to emerge through the tip portions. Owing to the resulting scattered light, the tip portions are rendered luminous. Where the glass body contains some projected portions for example owing to the cutting of the glass body, light beams are reflected by such projected portions and emerge through portions which are opposite to the projected portions. Thus, the latter portions are also rendered luminous.

Moreover, the upper surface of the glass body A is concave toward the center thereof. A through-hole 4 is formed at a desired position (at the central portion in the illustrated embodiment) of the glass body A in such a matter that the dense layer 3 is removed there. A light source 6 is provided within the through-hole 4. This light source 6 is connected by way of a conductor 7 to an external power supply. The light source 6 may be connected to a battery (not illustrated). The battery may then be disposed in the same plane as the lower surface of the glass body A, on which the light source 6 may be mounted. It is desirable to provide a light-shielding plate 5 over the upper opening of the through-hole 4, whereby preventing light from leaking out through the upper opening.

Figure 3:
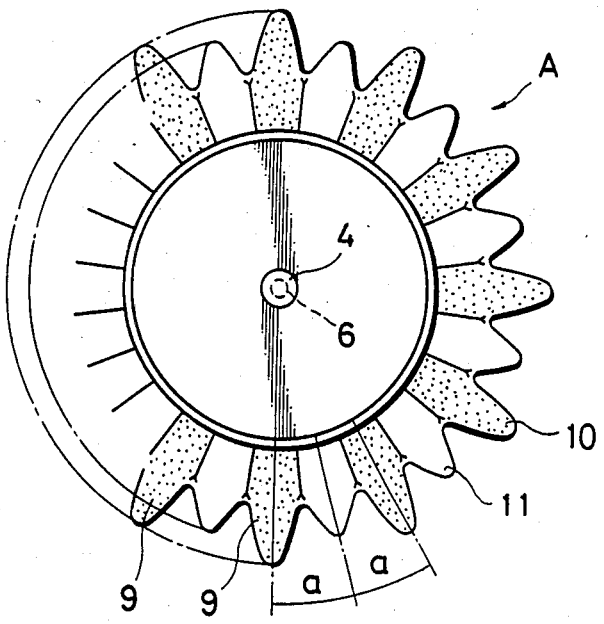
FIG. 3 is a top plan view of a decorator lamp according to the second embodiment of this invention.
Figure 4:
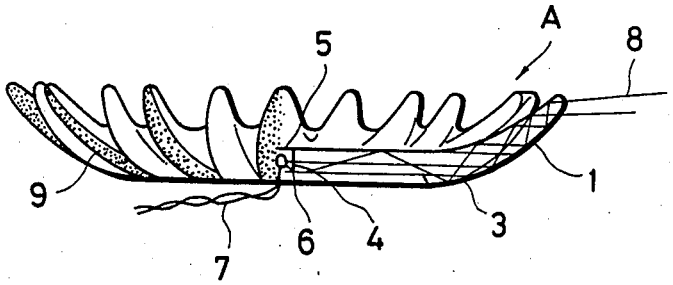
FIG. 4 is a partly cut-off side view of the decorator lamp of FIG. 3.

The second embodiment of this invention is illustrated in FIG. 3 and FIG. 4. Frosted areas or portions 9 are formed on the lower surface of a glass body A. By forming the frosted portions 9 at a constant angle a on either one group of alternating petal-like projections 10,11 (namely, on the projections 10 in the illustrated embodiment), light beams 4 which have been emitted from the light source 4 are reflected by the thus-frosted projections 10 so as to render the projections 10 luminous. Accordingly, an artistic optical pattern is produced.

When using a plurality of miniature bulbs as a light source, it is possible to use a colored miniature bulb instead of a usual miniature bulb. Furthermore, a high-luminance lamp may also be used in place of such a miniature bulb. It is also feasible to apply a colored transparent sheet on the inner wall of the through-hole, which inner wall surrounds the miniature bulb, so that the decorator lamp produce beautiful colors. Needless to say, the colored transparent sheet must withstand the bulb's heat.

The third embodiment of this invention will next be described with reference to FIG. 5 and FIG. 6, in which a number of miniature bulbs are arranged as a light source around a central bulb.

Letter A indicates a glass-made main body of the decorator lamp according to the third embodiment. The glass body A is somewhat bent outwardly (i.e., radially) and leftward (as seen in FIG. 5), thereby forming a number of petal-like projections 10,11. A through-hole 4 is centrally formed with such a diameter that the peripheral wall of the through-hole 4 can be fit closely over the outer circumference of a miniature bulb installation member 17. The miniature bulb installation member 17 has a height substantially equal to to the thickness from the lower surface to the upper surface of the glass body A. In the side wall of the miniature bulb installation member 17, there are formed with angular spacing recesses 18 having a depth equal to the maximum diameter of the miniature bulbs 6 so that the miniature bulbs 6 are received in the recesses 18 to avoid any damages of the miniature bulbs 6 by the peripheral wall of the through-hole 4 of the glass body A when the glass body A is fit over the miniature bulb installation member 17. Above the miniature bulb installation member 17, there is provided a bayonet base 13 which is provided with an externally-threaded portion 22. A holder cap 15 equipped with an internally-threaded portion 16 which is threadedly fit over the externally-threaded portion 22. The outer diameter of the lower peripheral edge of the holder cap 15 is somewhat larger than the diameter of the through-hole 4. Thus, when the holder cap 15 has been threadedly fit over the bayonet base 13, the glass body A is held in place between the holder cap 15 and the upper surface of the base 12. Within the bayonet base 13, there are provided a threaded metallic tube 20 adapted to hold a central bulb (not illustrated) and a socket contact 21 adapted to be brought into contact with the base contact of the central bulb. The base 12 is secured on a wall 17 by means of screws 14.

Since the the decorator lamp according to the third embodiment of this invention is constructed as mentioned above, the socket can be provided by placing electric wires at a suitable position in the wall 19 and fixing the base 12 on the electric wires with the screws 14. Then, the glass body A is fit over the miniature bulb installation member 17 so that the light source, which is composed of the miniature bulbs 17, is located within the thickness of the glass body A. Then, the holder cap 15 is threadedly fastened on the bayonet 13 which extends leftward from the glass body A, so that the glass body A is held in place between the base 12 and the flared proximal end edge of the holder cap 15. Thereafter, the central bulb is threadedly inserted in the threaded metallic tube 20 so as to hold the central bulb in place. This central bulb may be a colored bulb. When an internally-reflective bulb which has been used for decorative or ornamental purposes is used as the central bulb and the bulb is turned on, light is reflected within the bulb and is thus caused to travel rightward as viewed in FIG. 5. The light then passes through the glass body A and reaches the wall 19. Thus, the light projects a complex pattern corresponding to the glass body A, whereby producing unique and decorative effects. On the other hand, when the miniature bulbs 6 are turned on, their light passes through the peripheral wall of the through-hole 4 and is reflected back inwardly by the surfaces of the glass body A to the circumferential edge portions of the glass body A, through which the light emerges. Therefore, the decorator lamp looks as if it is luminous at its circumferential edge portions and produces significant decorative effects. The glass body A may be detached by unscrewing the holder cap 15. By providing various glass bodies defining through-holes of the same diameter, it is possible to replace with ease the glass body in accordance with the atmosphere. The peripheral wall of the through-hole 4 may be either colored or covered with a colored, transparent or translucent film to allow colored light to be reflected, thereby causing the more attractive colored light to emerge from the glass body A.

Figure 5:
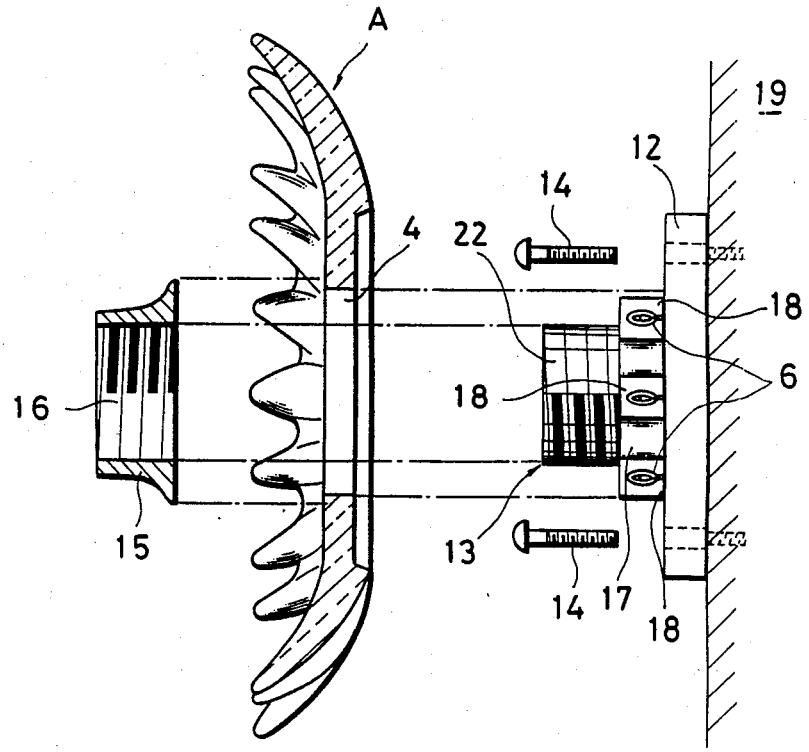
FIG. 5 is a partly-exploded, front view of a decorative lamp according to the third embodiment of this invention, in which certain elements are shown in cross-section for better understanding.
Figure 6:
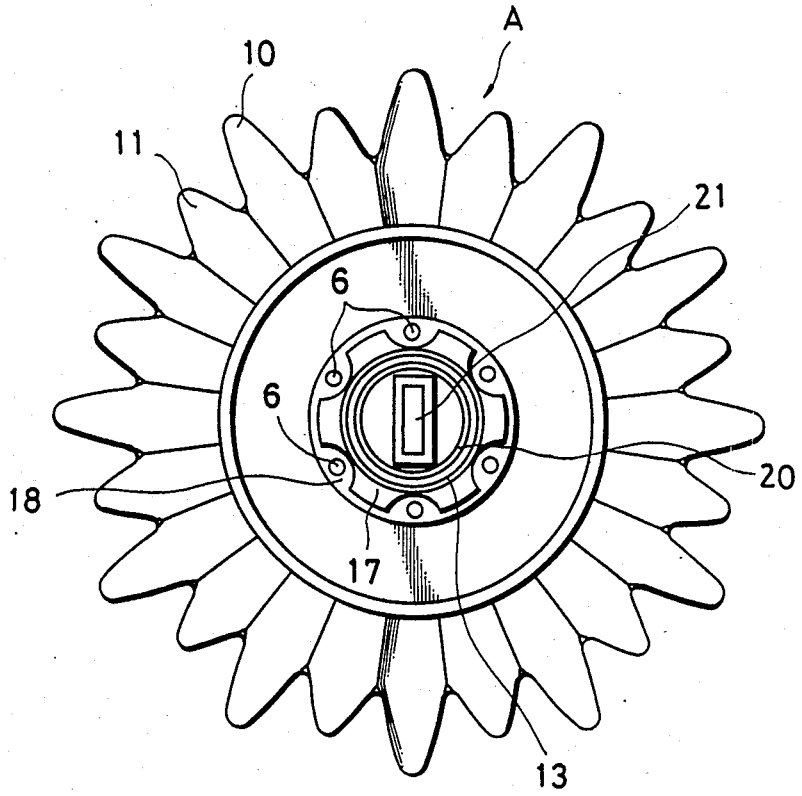
FIG. 6 is a side view of the decorative lamp of FIG. 5.
Figure 7:
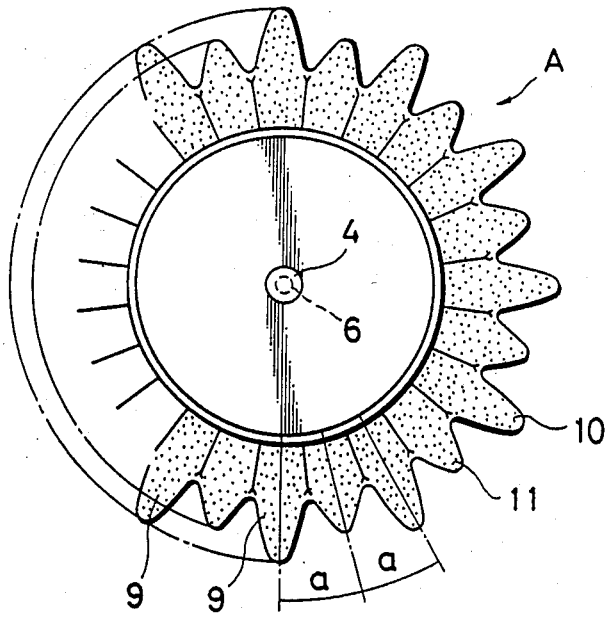
FIG. 7 is a top plan view of a decorator lamp similar to FIG. 3 but showing an entirely frosted rear surface.
Figure 8:
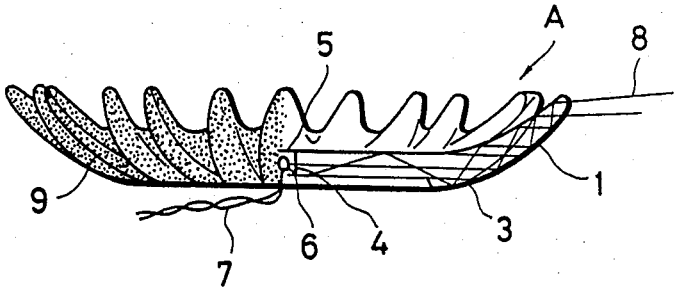
FIG. 8 is a partly cut-off side view of the decorator lamp of FIG. 7.

By the way, it should borne in mind that the configuration of the glass body A is not necessarily limited to that illustrated in FIG. 5 and FIG. 6. It may have such a great thickness that not only the miniature bulbs 6 but also the central bulb are received within the through-hole 4. The mounting position of the base 19 is not necessarily limited to the wall. It may be mounted on any place such as the ceiling or floor. While FIGS. 5 and 6 do not show a frosted surface, this embodiment, in common with the embodiment shown in FIGS. 3 and 4, can have all or part of its rear surface frosted.

The lighting of the decorator lamp may be effected by a switch provided separately from the decorator lamp. Alternatively, it may also be feasible to house a switch, which can automatically and selectively turn on the central bulb and miniature bulbs, within the decorator lamp.

As has been described above, a light source is provided within a glass-made main body of a decorator lamp which main body has been formed by one of suitable conventional shaping methods. The light from the light source is thus reflected back inwardly by the outer dense layer of the glass-made main body. The circumference of the disc-like glass body may be serrated to present alternating lands and recesses. The light is also reflected by the walls of lands and recesses. A variety of colors are thus produced at such dense layer, lands and recesses, depending on the angles of reflected light beams, thereby making the decorator lamp useful. In addition, by arranging as the light source a number of miniature bulbs around a central bulb in place of a single light bulb, still more beautiful, decorative or ornamental illumination can be achieved.

Having now fully described the invention, it will be apparent to one of ordinary skill in the art that many changes and modifications can be made thereto without departing from the spirit or scope of the invention as set forth herein.

I claim:

1. A decorator lamp comprising:

(A) a glass body having a surface concave toward the center of the surface and defining a through-hole formed centrally through the glass body in such a manner that the outer dense layer is removed at the desired position;

(B) a light source provided in the through-hole and composed of a central bulb and a plurality of miniature bulbs arranged in such a way that the miniature bulbs are located within the through-hole and, when seen in plan view of the decorator lamp, the miniature bulbs surround the central bulb, said miniature bulbs being arranged in a plane closer to the concave surface of the glass body than the central bulb;

(C) a miniature bulb installation member fit in the through-hole and holding the miniature bulbs therein, said miniature bulb installation member defining recesses at a constant angular interval in the peripheral side wall thereof, the miniature bulbs being received in said recesses;

(D) a mounting base arranged on the side of another surface of the glass body, said other surface being opposite to the concave surface;

(E) an externally-threaded bayonet base provided on the miniature bulb installation member and extending in a direction away from the concave surface; and (F) an internally-threaded holder cap fit over the bayonet base and having, at one end thereof which is closer to the concave surface, an outer diameter larger than the diameter of the through-hole so that the glass body is held in place between the holder cap and the mounting base.

2. A decorator lamp according to claim 1, wherein the glass body has a disc-like configuration.

3. A decorator lamp according to claim 2, wherein the circumference of the disc-like glass body is serrated to present alternating lands and recesses.

4. A decorator lamp according to claim 2, wherein the glass body has a petal-like configuration.

5. A decorator lamp according to claim 1, wherein the light source emits colored light.

6. A decorator lamp according to claim 1, further comprising:

a metallic tube provided within the bayonet base and holding the central bulb thereon; and a metallic tube including a socket contact to which the base contact of the central bulb is maintained in contact while the central bulb is held in the metallic tube.

7. A decorator lamp comprising a glass body having a surface concave toward the center of the surface and defining a through-hole formed at a desired position of the glass body in such a manner that the outer dense layer is removed at the desired position, a light source provided in the through-hole and composed of a central bulb and a plurality of miniature bulbs arranged in such a way that the miniature bulbs are located within the through-hole and, when seen in plan view of the decorator lamp, the miniature bulbs surround the central bulb, said glass body having a rear surface opposite to the concave surface, said rear surface being at least partly frosted.

8. A decorator lamp according to claim 7, wherein the glass body has a rear surface opposite to the concave surface and the rear surface is frosted in its entirety.

9. A decorator lamp according to claim 7, wherein the glass body has a rear surface opposite to the concave surface and the rear surface is partly frosted.

* * * * *